US006145593A

United States Patent [19]

Hennig

[11] Patent Number: 6,145,593

[45] Date of Patent: Nov. 14, 2000

[54] MAIN BORE ISOLATION ASSEMBLY FOR MULTI-LATERAL USE

[75] Inventor: Gregory E. Hennig, Aberdeen, United Kingdom

[73] Assignee: Baker Hughes Incorporated, Houston, Tex.

[21] Appl. No.: 09/135,922

[22] Filed: Aug. 18, 1998

[30] Foreign Application Priority Data

Aug. 20, 1997 [GB] United Kingdom ..... 9717572

[51] Int. Cl.[7] ..... E21B 43/14

[52] U.S. Cl. ..... 166/313; 166/50; 166/177.6

[58] Field of Search ..... 166/313, 50, 117.5, 166/117.6, 317, 332.4, 334.4, 376

[56] References Cited

U.S. PATENT DOCUMENTS

| | | | |
|---|---|---|---|
| 2,436,198 | 2/1948 | Cardwell et al. | 166/376 |
| 2,637,401 | 5/1953 | Ramsey . | |
| 2,781,852 | 2/1957 | Rumble . | |
| 2,791,278 | 5/1957 | Clark, Jr. . | |
| 2,831,540 | 4/1958 | Huber . | |
| 2,942,666 | 6/1960 | True et al. . | |
| 2,966,946 | 1/1961 | McCulloch et al. . | |
| 2,978,029 | 4/1961 | O'Reilly et al. . | |
| 3,035,639 | 5/1962 | Brown et al. . | |
| 3,333,635 | 8/1967 | Crawford | 166/229 |
| 3,374,838 | 3/1968 | Current . | |
| 3,542,128 | 11/1970 | Owen . | |
| 3,884,261 | 5/1975 | Clynch . | |
| 4,133,386 | 1/1979 | Knox . | |
| 4,157,732 | 6/1979 | Fonner | 166/376 |
| 4,224,987 | 9/1980 | Allen . | |
| 4,345,649 | 8/1982 | Baugh et al. . | |
| 4,796,707 | 1/1989 | Halbardier . | |
| 4,869,324 | 9/1989 | Holder . | |
| 4,928,762 | 5/1990 | Mamke . | |
| 5,271,468 | 12/1993 | Streich et al. . | |
| 5,311,936 | 5/1994 | McNair et al. . | |
| 5,749,419 | 5/1998 | Coronado et al. . | |
| 5,960,874 | 10/1999 | Morris et al. | 166/117.6 |
| 6,012,516 | 1/2000 | Brunet | 166/117.6 |

FOREIGN PATENT DOCUMENTS

| | | |
|---|---|---|
| 2255580 | 11/1992 | United Kingdom . |
| 2 277 546 | 11/1994 | United Kingdom . |

OTHER PUBLICATIONS

Walker, "Underbalanced Completions," SPE 30648, pp. 185–191 (Oct. 22, 1995).

*Primary Examiner*—William Neuder
*Attorney, Agent, or Firm*—Duane, Morris & Heckscher LLP

[57] ABSTRACT

An assembly, mountable below a whipstock, for engagement into an anchor packer is disclosed which has a valve member as a principal component. The assembly is stabbed into the anchor packer in a manner that isolates the main wellbore from the lateral to be created using the whipstock. An equalization feature facilitates the stabbing in of the assembly into the anchor packer. Upon concluding the stabbing in, the equalization opening closes and locks in the closed position. Thereafter, the lateral is created by milling a window (in the case of a cased wellbore) and drilling the lateral. Liners may be used within the lateral and are insertable by use of the whipstock. At any desired time when production is to resume from below the whipstock, the valve member is actuated while the anchor packer remains in position to hold the whipstock. The valve member can be actuated by mechanically shifting a sleeve or by dissolution with chemical attack of a dissolvable plug or by other techniques. The opening of the valve member can also be accomplished by a signal from the surface which travels through the wellbore, such as an acoustic signal, which is received downhole which ultimately actuates the valve member to the open position. Provisions can also be made to subsequently close the valve should it become necessary to isolate the main wellbore below the whipstock at a future time. This can be accomplished with the use of previously mentioned methods or the use of battery-powered activated memory metal technology.

23 Claims, 3 Drawing Sheets

MAIN BORE ISOLATION ASSEMBLY FOR MULTI-LATERAL USE

FIELD OF THE INVENTION

The field of this invention relates to assemblies which allow for isolation of a main wellbore below a whipstock while a lateral is being drilled, with the ability to subsequently produce through the main wellbore after a window or a lateral bore is completed.

BACKGROUND OF THE INVENTION

In existing wells, the need arises to enhance production by drilling one or more laterals. Some of these wells are cased and are producing through the main wellbore. In some situations, it is desirable to resume production from below the lateral after the lateral is completed. At the same time, it is desirable to be able to isolate the wellbore below the lowermost lateral while the lateral is being drilled. The reason for this is that the formation below the lowest lateral can be adversely affected by hydraulic pressures brought on it from the drilling fluid gradient and/or equivalent circulating density. For that reason, it is advantageous to be able to isolate the wellbore below a whipstock, and at a later time allow flow to resume after the window exit has been created or at any point thereafter upon completion of the lateral or laterals.

In some situations, it is required to isolate the main bore while drilling the lateral or laterals above the window exit. The lateral may require the drilling fluid to be such that the fluid gradient would not control the main bore reservoir. In this situation, the main bore must be isolated. Upon completion of these uphole operations, the isolation or well control of the main wellbore is not required.

In the past, whipstocks have been available with a full or partially open bore therethrough for the purpose of allowing subsequent flow from below the whipstock from the main wellbore at the conclusion of milling of the window and drilling the lateral. However, these prior designs did not provide the ability to isolate the main wellbore below the whipstock during the milling of the window, the drilling of the lateral, or the insertion of a liner into the lateral.

Accordingly, an object of the invention is to be able to selectively provide communication from the main wellbore around the whipstock while leaving the whipstock in place. With the whipstock in place, it can be used to guide a liner into the lateral, while at the same time allow selectively the resumption of flow from the main wellbore to the surface. Another objective of the invention is to allow the opening of the main wellbore from below the whipstock to be accomplished in a variety of techniques. Some of these techniques include chemical attack through the dissolving of a plug, mechanically shifting a sleeve, or the use of signals from the surface communicated through the wellbore to the valve below the whipstock to actuate it when desired. These and other objectives of the present invention will be more readily understood by a review of the detailed specification which appears below.

SUMMARY OF THE INVENTION

An assembly, mountable below a whipstock, for engagement into an anchor packer is disclosed which has a valve member as a principal component. The assembly is stabbed into the anchor packer in a manner that isolates the main wellbore from the lateral to be created using the whipstock. An equalization feature facilitates the stabbing in of the assembly into the anchor packer. Upon concluding the stabbing in, the equalization opening closes and locks in the closed position. Thereafter, the lateral is created by milling a window (in the case of a cased wellbore) and drilling the lateral. Liners may be used within the lateral and are insertable by use of the whipstock. At any desired time when production is to resume from below the whipstock, the valve member is actuated while the anchor packer remains in position to hold the whipstock. The valve member can be actuated by mechanically shifting a sleeve or by dissolution with chemical attack of a dissolvable plug or by other techniques. The opening of the valve member can also be accomplished by a signal from the surface which travels through the wellbore, such as an acoustic signal, which is received downhole which ultimately actuates the valve member to the open position. Provisions can also be made to subsequently close the valve should it become necessary to isolate the main wellbore below the whipstock at a future time. This can be accomplished with the use of previously mentioned methods or the use of battery-powered activated memory metal technology.

DETAILED DESCRIPTION OF THE PREFERRED EMBODIMENT

Figure 1:
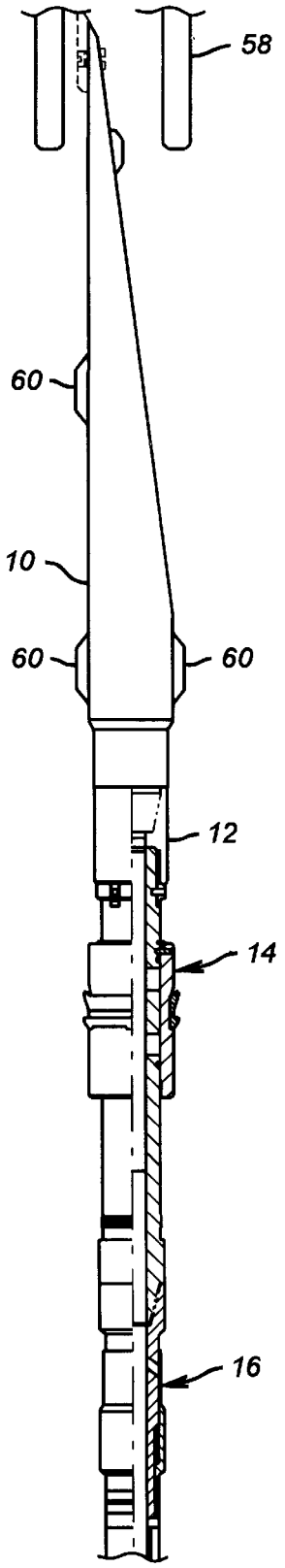
FIG. 1 is a sectional elevational view showing the assembly with the whipstock with the excluder sub housing which has the valve member in it, as well as the equalization port housing below.

Referring to FIG. 1, the whipstock 10 has a top sub 12 connected below. Secured to the top sub 12 is ported body mandrel 20, which carries the excluder sub housing 14. Mounted below is equalization port housing 16. The equalization port housing 16 is ultimately connected to a drilling anchor 18, which is latch into the packer (not shown) which ultimately supports the whipstock 10. The packer, in the customary manner, when set, provides an orientation profile for the whipstock 10, as well as resistance to torque applied to the whipstock 10 during milling of a window in a cased wellbore and subsequent well operations.

Figure 2:
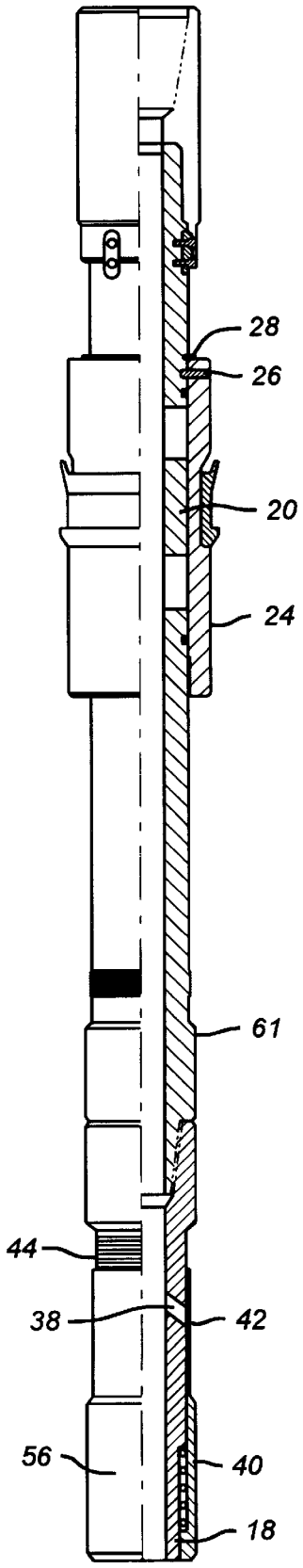
FIG. 2 is the view of FIG. 1 in greater detail, showing the individual components of the excluder sub housing and the equalization port housing.
Figure 3:
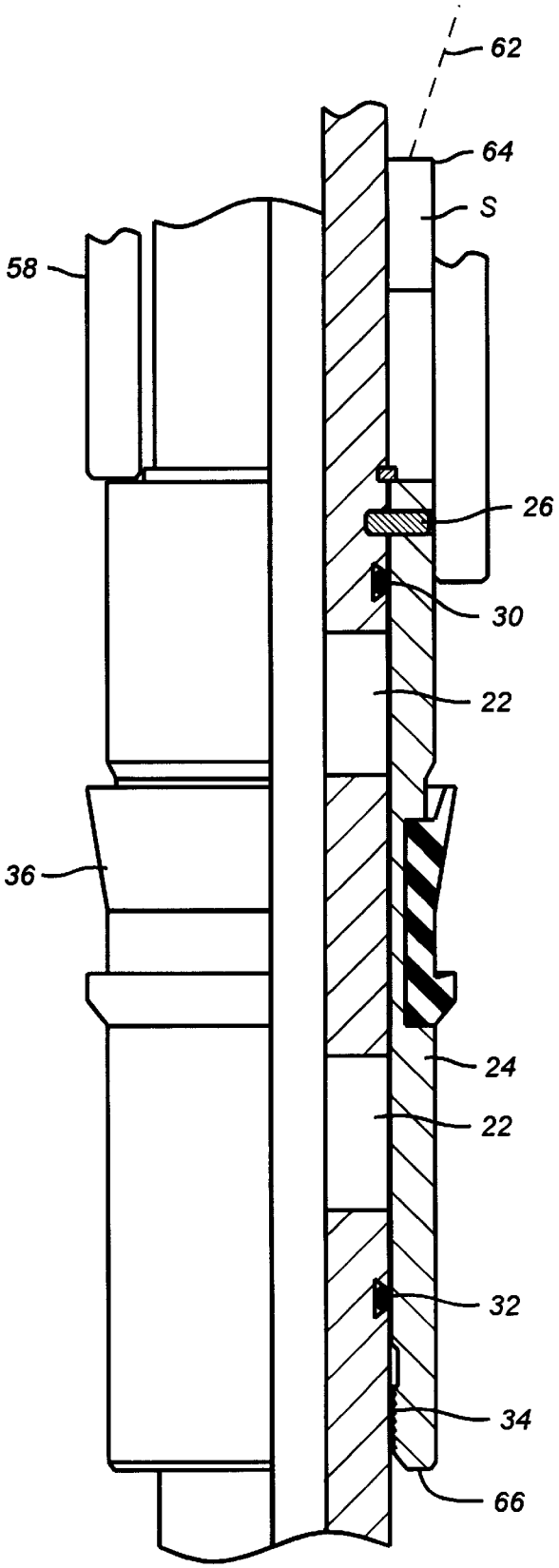
FIG. 3 is a detail of the excluder sub housing shown in section in the closed position.
Figure 5:
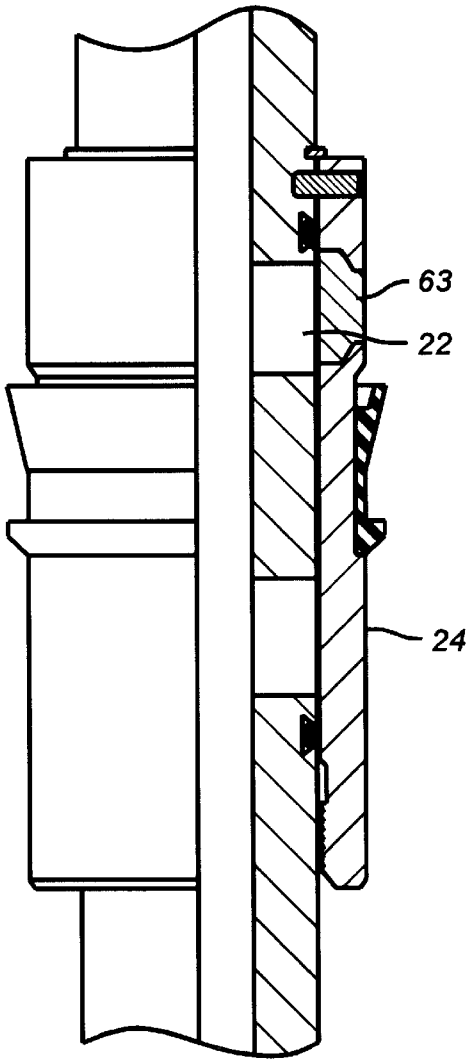
FIG. 5 is a sectional elevational view of an alternative embodiment of the valve assembly in the excluder sub housing.
Figure 4:
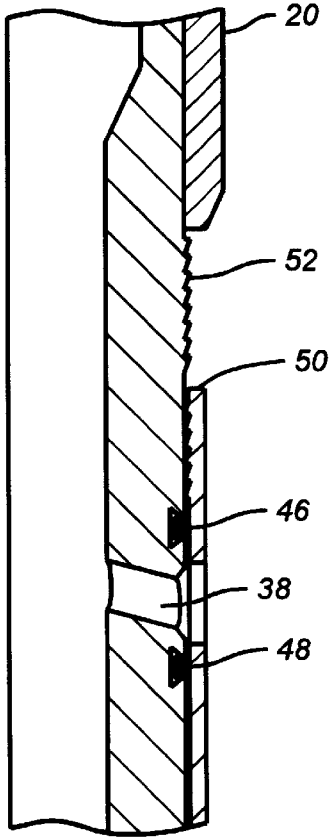
FIG. 4 is a detail of the equalization port housing in the open position.

The details of the excluder sub housing 14 are shown in FIGS. 2 and 5. As seen in FIG. 2, a body 20 has openings 22 over which fits sleeve 24. Sleeve 24 is retained to the body 20 by shear pins 26 or a shear ring (not shown). The upward travel of sleeve 24 is limited by snap ring 28. These components are shown in larger detail in FIG. 3. Referring to FIG. 3, there are upper and lower flow ports 22 illustrated which are effectively isolated in the closed position by virtue of O-ring seals 30 and 32. A ratchettype locking profile comprising teeth 34 helps to hold the sleeve 24 in the closed position shown in FIG. 3. On the outside of sleeve 24 is a debris seal 36 which traps any debris that may fall down around the whipstock 10 during the milling of the window operation.

As the assembly shown in FIG. 1 is advanced to the packer (not shown) and stabbed into it, an equalization passage 38 (see FIG. 2) allows the completion of the stab-in operation as fluid is displaced through the passage 38. A fluid lock is thus prevented when passage 38 is open. Equalization ported housing 16 has an opening 42 which is aligned with passage 38 during the run-in and until the final movements of stabbing-in occur. As the stabbing operation is concluded, the sleeve 40, which is biased downwardly by a spring 44, is shifted upwardly, thus bringing opening 42 of the equalization housing 16 into misalignment with passage 38 and compressing spring 44. With the presence of 0-rings 46 and 48 on body 20, which straddle passage 38, flow is terminated at the conclusion of the stabbing-in operation.

The final movements prior to the conclusion of the stabbing-in operation are the sleeve 40 is shifted against the bias of spring 44, bringing into engagement the upper end 50 of the equalization housing 16 with the lock profile 52 on the body 20. The equalization port housing 16 is in the closed position at the conclusion of the stabbing-in operation and it is locked in place in that position. With a solid portion of the equalization port housing now covering across the passage 38 and the O-rings 46 and 48, this will prevent future flow through passage 38 from the wellbore below, indicated generally as 56 in FIG. 2.

Referring again to the sleeve 24 on the excluder sub housing 14, when it is desirable to allow flow from the main wellbore 56 through the openings 22, the sleeve 24 can be shifted. This is accomplished by washing over the whipstock 10 with a mill 58. The mill 58 is designed to mill off tabs 60. Tabs 60 are stabilizers or centralizers that can be made out of an alloy. It is desirable to have the mill 58 positioned so that it will easily cut through the tabs 60 and, yet, at the same time avoid any significant damage to the whipstock 10. The mill 58 is of a type well-known in the art and can be of the type made by Baker Hughes and known as one of its Metal Muncher® product lines. The mill 58 descends over the whipstock 10 until it makes contact with the sleeve 24 as schematically illustrated in FIG. 3. At that point, weight is set down from the surface to push down on sleeve 24 to break shear pin 26 or shear ring (not shown). The teeth 34 engage the body 20 to hold the sleeve 24 in a position where openings 22 are exposed. A shoulder 61 on the body 20, as shown in FIG. 2, acts as a travel stop for the sleeve 24.

Another way to expose the openings 22 is shown in FIG. 5. There, an insert 63, which can be made from a dissolvable or otherwise removable material, such as magnesium or aluminum, etc., can be inserted as a component part of the sleeve 24. In this embodiment, after the conclusion of the drilling of the lateral and perhaps the running of a slotted liner into the lateral above the whipstock 10, acid can be spotted adjacent the insert 63 which will dissolve it. Upon dissolution or other comparable technique to get insert 63 out of the way of the insert 63, the openings 22 will then allow flow from the wellbore below 56 around the whipstock 10.

Alternative ways of moving the sleeve 24 can also be provided. Illustrated schematically in FIG. 3 as an alternative to the setdown weight from the mill 58 is the use of a device which can create a necessary force to move the sleeve 24. This device can be a reaction which generates pressure so as to physically drive the sleeve 24 downhole to expose openings 22. Using known techniques to create pressure downhole, a signal, represented schematically as 62, can be sent from the surface to a controller 64. The controller 64 can initiate the reaction or other mechanism which is used to shift the sleeve 24. The signal 62 can be in a variety of forms, including acoustic or electrical, using the technology available from Baker Hughes and known as Edge®. Also, the use of battery power to activate memory metal to open and close, accessing a flow port, could be utilized. FIG. 3 illustrates that a component of the control system 64 is the mechanism referred to as "S" which will actually generate the pressure or, in other forms, generate the energy required to shift the sleeve 24. Omitted for clarity in the drawing is a duplicate assembly to the controller 64 and the energy-creating mechanism S depicted at the top of the sleeve 24 but now locatable at the bottom of the sleeve 24. Accordingly, if it is desired to be able to reclose the openings 22, a similar assembly to the controller 64 and the energy-creating mechanism S can be placed in the lower end 66 of the sleeve 24 and responsive to a different signal from the surface to reclose openings 22 if desired.

There are several advantages to the system as described above. The whipstock 10, once located, stays in position for the milling of the window, the drilling of the lateral, and the running of liners into the lateral. At whatever time is desired by the operator, production from below the whipstock 10 can resume by exposing openings 22. As previously disclosed, this can be accomplished in a number of ways involving moving a sleeve 24 or dissolving or otherwise removing portions of sleeve 24 sufficient to allow flow through passages 22. Thus, in some applications where the operator does not desire to use acid to open up flow from the main wellbore 56, the technique of using a mill such as 58 to wash over the whipstock 10 and ultimately bear down on the sleeve 24 is an alternative technique that can be used. Sleeve 24 can be shifted in other ways by initiating with a surface signal, such as 62, a mechanism S which will move the sleeve 24. Yet other techniques for opening the openings 22 after the lateral is produced with the whipstock 10 are within the purview of the invention. Apart from a setdown force, such as illustrated using mill 58, other techniques such as a J-slot-type mounting for the sleeve 24 can be employed without departing from the spirit of the invention.

It should be noted that other laterals can be drilled in the pre-existing wellbore while the lowermost whipstock 10 continues to isolate the main wellbore 56 below with the assembly shown in FIG. 1. At the conclusion of the drilling of the various laterals, the techniques described above can be employed for exposing the openings 22.

By avoiding the need to pull the whipstock 10 to retrieve the mechanical barrier, the main wellbore 56 can remain isolated and operations which have been used in the past, such as the rerunning of a flow-through whipstock or diverter system, can be eliminated. In essence, a barrier to the wellbore below 56 remains in place while one or more laterals are drilled and liners, if necessary, are run into the laterals. Only when it is desired is the main wellbore 56 reopened for communication to the surface without having to dislodge the original whipstock 10. Thus, the formation in the main wellbore below the whipstock 10 is, in effect, isolated from the potentially undesirable pressure effects which may occur in the main wellbore 56 below the whipstock 10, and the main wellbore above the whipstock 10 to surface is isolated from the potentially undesirable pressure effect from the main wellbore below the whipstock 10. Thus, the present invention provides selective isolation to preserve the integrity of the formation in the main wellbore 56 while one or more laterals are drilled and assist in well control during drilling and completion operations.

The foregoing disclosure and description of the invention are illustrative and explanatory thereof, and various changes in the size, shape and materials, as well as in the details of the illustrated construction, may be made without departing from the spirit of the invention.

What is claimed is:

1. A wellbore isolation device for use in forming a lateral through a wellbore wall comprising:

a whipstock;

a support assembly to sealingly support the whipstock to the well-bore wall for forming at least one lateral through the wellbore wall;

a valve member selectively operable between a closed position wherein flow past said support assembly is substantially shut off and an open position where flow past said support assembly can occur.

2. The device of claim 1, wherein:

said valve member comprises a sliding sleeve which exposes a port for flow around said whipstock.

3. The device of claim 1, wherein:

said valve member comprises a material obstructing a port which when removed allows flow through said port around said whipstock.

4. The device of claim 3, wherein:

said material is removed by introduction of a chemical.

5. The device of claim 3, wherein:

said material is dissolved.

6. The device of claim 2, further comprising:

an actuating mechanism for said sleeve to move it in at least one direction.

7. The device of claim 6, wherein:

said actuating mechanism operable in response to a signal.

8. The device of claim 7, wherein:

said signal originates from the surface of the wellbore.

9. The device of claim 7, wherein:

said signal originates in the wellbore adjacent said whipstock.

10. The device of claim 8, wherein:

said actuating mechanism selectively moves said sleeve in one of two opposed directions responsive to different signals.

11. The device of claim 10, wherein:

said signal triggers a reaction which creates the required force for moving said sliding sleeve.

12. A wellbore isolation device for use in lateral completions, comprising:

a whipstock;

a support assembly to sealingly support the whipstock in a well-bore for forming at least one lateral;

a valve member selectively operable between a closed position wherein flow past said support assembly is substantially shut off and an open position where flow past said support assembly can occur;

said valve member comprises a sliding sleeve which exposes a port for flow around said whipstock;

said valve member is actuated by a tool which washes over said whipstock without damaging it so that said tool can apply a moving force to said sleeve.

13. The device of claim 12, further comprising:

centralizers on said whipstock;

said tool milling off at least some of said centralizers prior to contact with said sleeve for shifting thereof.

14. The device of claim 12, wherein:

said tool shifts said sleeve by setdown weight from the surface acting through said tool.

15. The device of claim 12, wherein:

said tool causes relative movement in said valve member which in turn results in operation of said valve member between said open and closed positions.

16. A method of forming a lateral in a wellbore wall, comprising:

providing an isolation device against the wellbore wall;

running in a whipstock with a valve assembly to said isolation device;

forming a lateral through the wellbore wall with a portion of the wellbore isolated at a point below said whipstock due to, at least in part, said valve assembly being in the closed position;

opening said valve assembly to provide flow access from below said whipstock with said whipstock in place.

17. The method of claim 16, further comprising:

operating said valve assembly from the surface of the well.

18. The method of claim 16, further comprising:

using a sliding sleeve as the valve assembly.

19. The method of claim 16, further comprising:

using a plug in a port which can be removed chemically as said valve assembly.

20. The method of claim 18, further comprising:

providing an actuating mechanism to move said valve assembly in at least one direction responsive to at least one signal from the surface.

21. A method of forming a lateral in a wellbore, comprising:

providing an isolation device in the wellbore;

running in a whipstock with a valve assembly to said isolation device;

forming a lateral with a portion of the wellbore isolated at a point below said whipstock due to, at least in part, said valve assembly being in the closed position;

opening said valve assembly to provide flow access from below said whipstock with said whipstock in place;

providing an equalization sub adjacent one of said valve assembly and whipstock to allow stabbing into said isolation device without fluid lock.

22. A method of forming a lateral in a wellbore, comprising:

providing an isolation device in the wellbore;

running in a whipstock with a valve assembly to said isolation device;

forming a lateral with a portion of the wellbore isolated at a point below said whipstock due to, at least in part, said valve assembly being in the closed position;

opening said valve assembly to provide flow access from below said whipstock with said whipstock in place;

using a sliding sleeve as the valve assembly;

providing a debris barrier adjacent said sleeve.

23. A method of forming a lateral in a wellbore, comprising:

providing an isolation device in the wellbore;

running in a whipstock with a valve assembly to said isolation device;

forming a lateral with a portion of the wellbore isolated at a point below said whipstock due to, at least in part, said valve assembly being in the closed position;

opening said valve assembly to provide flow access from below said whipstock with said whipstock in place;

using a sliding sleeve as the valve assembly using a tool to wash over said whipstock to apply a force to shift said sleeve.

* * * * *